US005975888A

United States Patent [19]

Hsu

[11] Patent Number: 5,975,888

[45] Date of Patent: Nov. 2, 1999

[54] ELECTRONIC IGNITION GUN

[76] Inventor: Huang-Hsi Hsu, 8F, No. 14, Lane 252, Chungshan N. Rd., Sec. 6, Taipei, Taiwan

[21] Appl. No.: 09/193,418

[22] Filed: Nov. 18, 1998

[51] Int. Cl.[6] ..... F23Q 7/12

[52] U.S. Cl. ..... 431/255; 431/256; 431/344; 126/401; 126/405

[58] Field of Search ..... 431/255, 256, 431/344, 153, 142; 126/401–409, 414, 415, 229

[56] References Cited

U.S. PATENT DOCUMENTS

| | | | |
|---|---|---|---|
| 4,292,021 | 9/1981 | Miyagawa | 431/255 |
| 4,516,933 | 5/1985 | Buzzi | 431/255 |
| 5,496,169 | 3/1996 | Chen | 431/255 |
| 5,865,614 | 2/1999 | Hsu | 431/255 |

*Primary Examiner*—James C. Yeung
*Attorney, Agent, or Firm*—Bacon & Thomas

[57] ABSTRACT

An electronic ignition gun includes a casing holding a fuel gas container, a battery and a high voltage circuit on the inside, the fuel gas container having a gas outlet valve and a pull tab coupled to the gas outlet valve, a push-button switch mounted in a hole on the casing and depressed to drive the pull tab in opening the gas outlet valve for letting fuel gas be discharged out of the fuel gas container through a gas nozzle via a gas tube and to simultaneously close the circuit between the high voltage circuit and the battery, causing the high voltage circuit to discharge a high voltage in producing sparks for igniting discharged fuel gas, and safety lock means, which stops the push-button switch from operation.

9 Claims, 5 Drawing Sheets

ELECTRONIC IGNITION GUN

BACKGROUND OF THE INVENTION

The present invention relates to an electric ignition gun, and more particularly to an electric ignition gun that can easily be operated to catch fire by depressing a push-button switch.

FIG. 1 shows an electronic ignition gun according to the prior art. This electronic ignition gun includes a casing 1 having a sliding slot 11 at one side, and a sliding switch 12 mounted on the casing 1 and moved back and forth in the sliding slot 11. The sliding switch 12 comprises a handle 121 disposed outside the casing 1, a substantially L-shaped stop plate 122 coupled to the handle 121 and disposed inside the casing 1. The stop plate 122 has one end coupled to the handle 121, and an opposite end terminating in a stop wall 1221. The casing 1 defines a storage chamber 13, which holds a fuel gas container 14. The fuel gas container 14 has a gas outlet valve connected to a flexible gas tube 142. The flow rate of the gas outlet valve of the fuel gas container 14 is controlled by a gas flow rate control 141. A coupling plate 143 is provided having one end coupled to the connecting area between the gas outlet valve of the fuel gas container 14 and the flexible gas tube 142, and an opposite end mounted with a spring 144. The spring 144 has one end connected to the coupling plate 143, and an opposite end situated above the stop wall 1221 of the stop plate 122. The opposite end of the flexible gas tube 142 is connected with a metal gas nozzle 145, having a front end on which is mounted with a gas flow buffer spring 146. The gas flow buffer spring 146 buffers the flowing speed of discharged fuel gas, enabling discharged fuel gas to be well mixed with air. The casing 1 further comprises a locating groove 15 on the inside at its front end, which receives the metal gas nozzle 145. The front end of the casing 1 is mounted with a metal flame nozzle 17. A piezoelectric igniter 18 is mounted in the casing 1 and coupled to the stop plate 122 of the sliding switch 12, and has two electric wires 2 respectively extended from its two opposite terminals and respectively connected to the metal gas nozzle 145 and the metal flame tube 17. When the sliding switch 12 is pushed in one direction, the coupling plate 143 is forced to pull the flexible gas tube 142, causing fuel gas to flow out of the gas outlet valve of the fuel gas container 14 through the flexible gas tube 142 to the metal gas nozzle 145, and at the same time the piezoelectric igniter 18 is driven to discharge a high voltage through the metal gas nozzle 145 and the metal flame tube 17 via the electric wires 2, thereby causing sparks to be produced in the space between the metal gas nozzle 145 and the metal flame tube 17, and therefore discharged fuel gas is ignited at the front end of the metal gas nozzle 145. Because the operation of the piezoelectric igniter 18 and the discharging of fuel gas from the fuel gas container 14 are controlled by the sliding operation of the sliding switch 12, the user must employ much effort to move the sliding switch 12 when operating the electronic ignition gun. If insufficient push force is applied to the sliding switch 12, the piezoelectric igniter 18 cannot be positively triggered to discharge a high voltage.

SUMMARY OF THE INVENTION

The present invention has been accomplished to provide an electronic ignition gun which eliminates the aforesaid problem. According to one aspect of the present invention, the electronic ignition gun comprises a casing holding a fuel gas container, a battery and a high voltage circuit on the inside, the fuel gas container having a gas outlet valve and a pull tab coupled to the gas outlet valve, and a push-button switch mounted in a hole on the casing, wherein when the push-button switch is depressed, the pull tab is driven to open the gas outlet valve for letting fuel gas be discharged out of the fuel gas container through a gas nozzle via a gas tube, and at the same time the open circuit between the high voltage circuit and the battery is closed by a metal contact plate at the bottom side of the push-button switch, causing the high voltage circuit to discharge a high voltage in producing sparks for igniting discharged fuel gas. According to another aspect of the present invention, a safety lock means is provided to stop the push-button switch from operation. The push-button switch is allowed to be depressed only when the safety lock means is unlocked.

DETAILED DESCRIPTION OF THE PREFERRED EMBODIMENT

Figure 1:
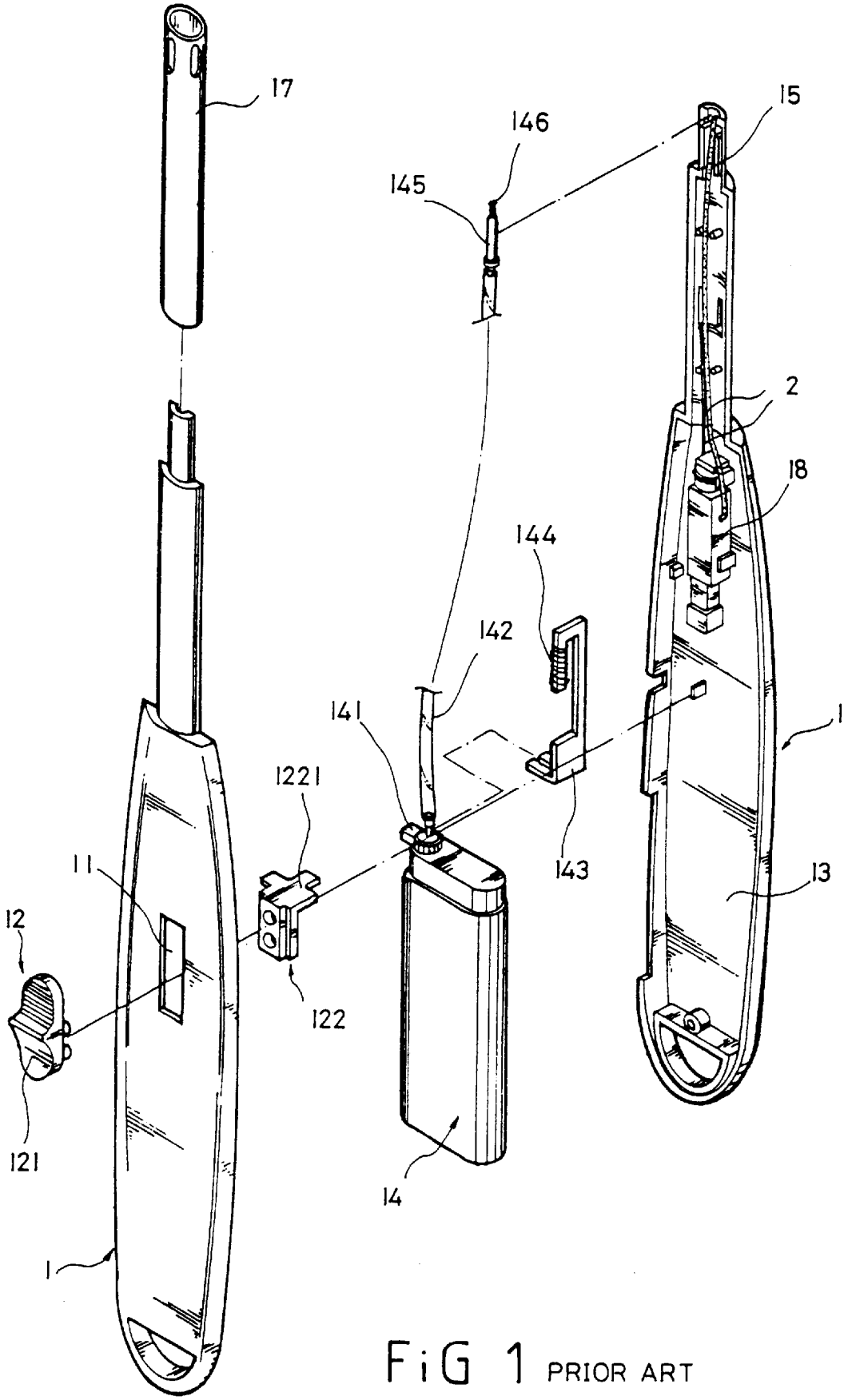
FiG 1 PRIOR ART
FIG. 1 is an exploded view of an electronic ignition gun according to the prior art.
Figure 2:
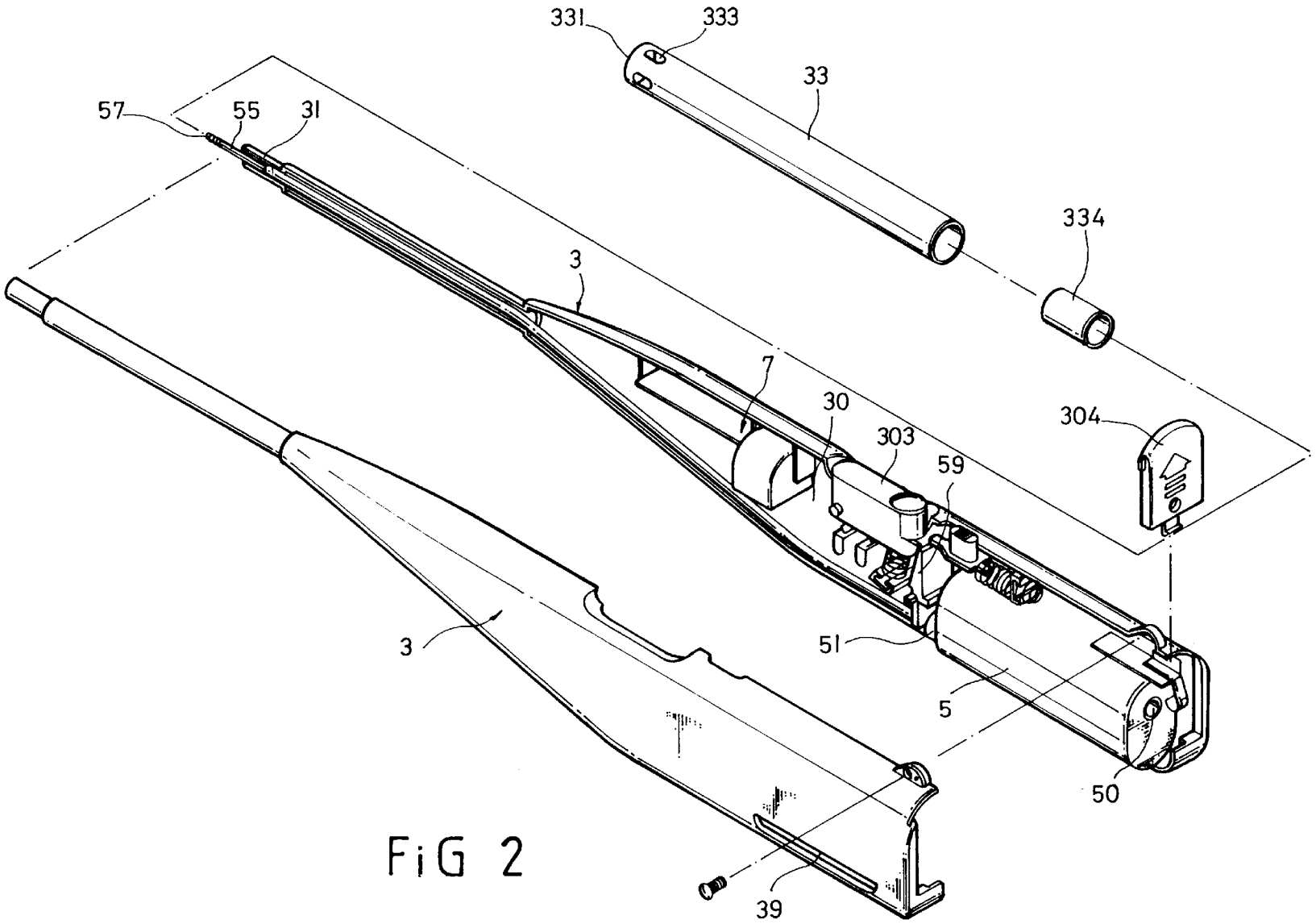
FIG. 2 is an exploded view of an electronic ignition gun according to the present invention.
Figure 3:
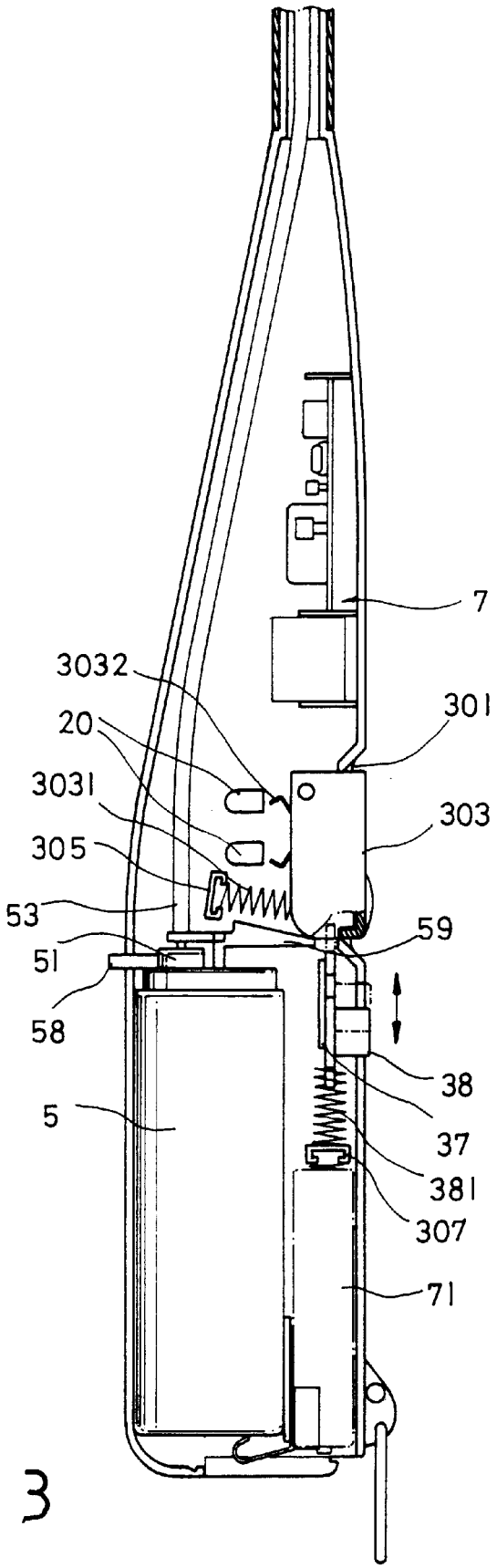
FIG. 3 is a perspective assembly view of the electronic ignition gun shown in FIG. 2.

Referring to FIGS. 2 and 3, an electronic ignition gun in accordance with the present invention is generally comprised of a casing 3 defining a receiving chamber 30, a fuel gas container 5 and a high voltage circuit 7 mounted in the receiving chamber 30 inside the casing 3. The fuel gas container 5 comprises a gas filling valve 50 at its bottom side, and a gas outlet valve 51 at its top side. A flexible gas tube 53 is connected between the gas outlet valve 51 and a metal gas nozzle 55 positioned in a hole 31 at the front end of the casing 3. The metal gas nozzle 55 has a front gas outlet on which is mounted a gas flow buffer spring 57. The gas flow buffer spring 57 buffers the flowing speed of discharged fuel gas, enabling discharged fuel gas to be well mixed with air. A metal flame tube 33 is fastened to the front end of the casing 3 around the metal gas nozzle 55. The metal flame tube 33 has a flame output hole 331 at its front end, and a plurality of air vents 333 spaced around the periphery adjacent to the flame output hole 331. An insulative bushing, for example a ceramic bushing 334, is mounted within the flame tube 33 around the metal gas nozzle 55. A gas flow rate control 58 is coupled to the gas outlet valve 51 of the fuel gas container 5, and operated to regulate the flow rate of fuel gas. The gas flow rate control 58 has a part that extends out of a hole in the casing 3 to permit manual operation. A pull tab 59 is pivoted to the gas outlet valve 51 of the fuel gas container 5. The high voltage circuit 7 has one end connected to the metal gas nozzle 55, and an opposite end connected to one end of a power supply device for example a battery 71 positioned in a receiving chamber 30 of the casing 3, by a lead wire. The opposite end of the battery 71 is connected to the metal flame tube 33 by a lead wire.

A push-button switch 303 is mounted in a hole 301 at the casing 3, and spaced above the pull tab 59. One end of the bottom side of the push-button switch 303 is pivoted to a rod (not shown) inside the casing 3. The other end of the bottom side of the push-button switch 303 is connected to one end of a spring element 3031. The other end of the spring element 3031 is connected to a recessed seat 305 in the receiving chamber 30 inside the casing 3. An arched metal contact plate 3032 is fixedly fastened to the bottom side of the push-button switch 303. An open circuit 20 is provided at the lead wire between the high voltage circuit 7 and the battery 71 adjacent to the metal contact plate 3032. When the push-button switch 303 is depressed, the metal contact plate 3032 is lowered to contact the two opposite ends of the open circuit 20, causing the high voltage circuit 7 and the battery 71 to be electrically connected, and at the same time the pull tab 59 is forced by the push-button switch 303 to open the gas outlet valve 51 of the fuel gas container 50, enabling fuel gas to flow out of the fuel gas container 50. Further, a lid 304 covers on the casing 3 to hold the battery 71 inside the casing 3.

Figure 4:
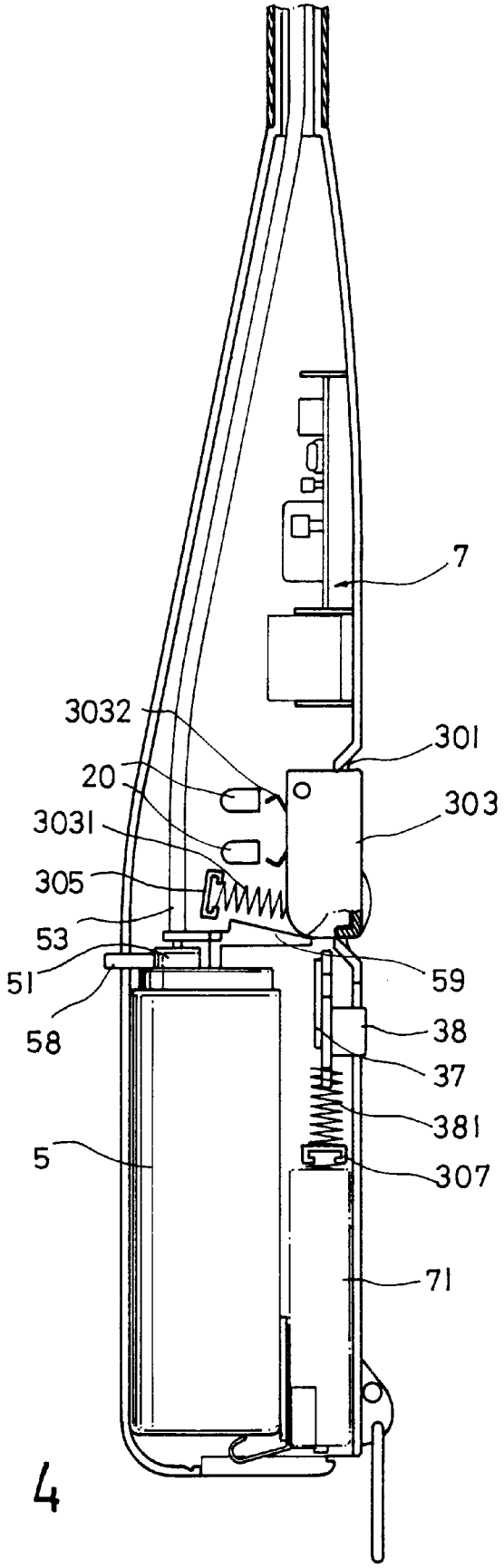
FIG. 4 illustrates the stop plate disengaged from the push-button switch according to the present invention.

Referring to FIGS. 4 and FIG. 3 again, the casing 3 comprises a sliding rail 37 on the inside adjacent to the push-button switch 303. A stop plate 38 is mounted on the sliding rail 37. A spring element 381 is provided having one end connected to the stop plate 38 and an opposite end fastened to a recessed seat 307 inside the casing 3. The spring element 381 imparts a forward pressure to the stop plate 38, causing the stop plate 38 to stop the push-button switch 303 from downward movement. Therefore, the push-button switch 303 can be operated only when the stop plate 38 is pushed backwards from the push-button switch 303.

Referring to FIG. 2 again, the casing 3 comprises a longitudinal peephole 39 through which the user can visually check the volume of fuel gas in the fuel gas container 5. When fuel gas is going to be used up, a new supply of fuel gas can be filled in the fuel gas container 5 through the gas filling valve 50.

Figure 5:
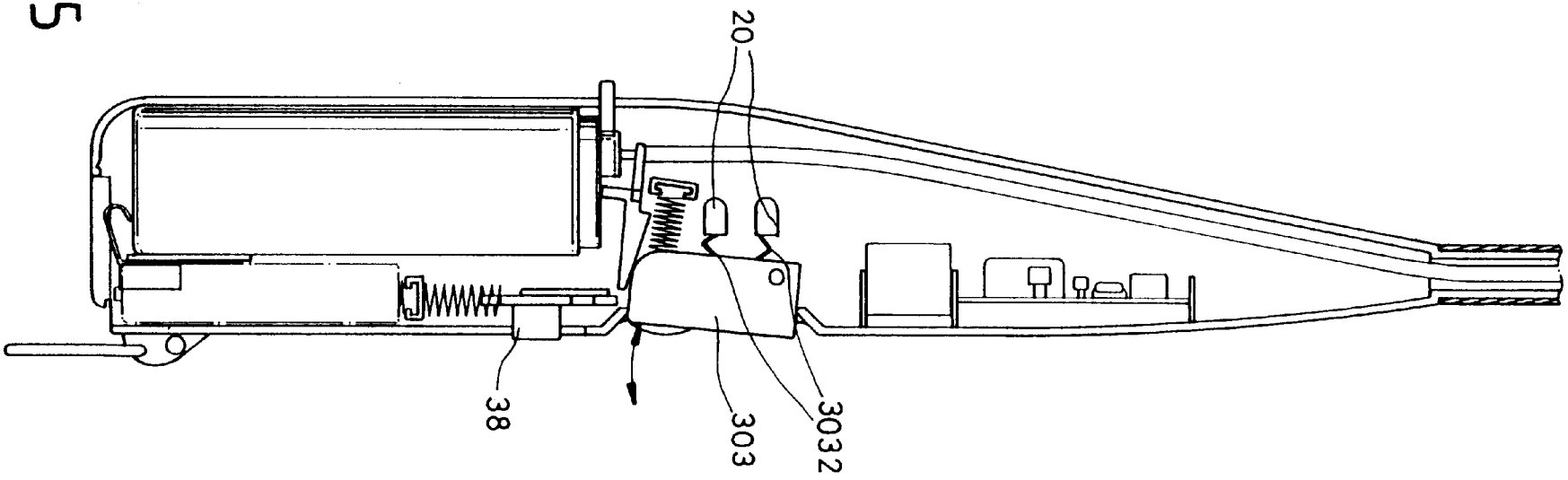
FIG. 5 illustrates the push-button switch depressed, the open circuit closed according to the present invention.

Referring to FIGS. from 2 through 5 again, the stop plate 38 is forced by the spring element 381 to stop the push-button switch 303 from downward movement, preventing the push-button switch 303 from being operated (see FIG. 3). When in use, the stop plate 38 is pushed away from the push-button switch 303 (see FIG. 4), then the push-button switch 303 is depressed to force the metal contact plate 3032 into contact with the two opposite ends of the open circuit 20 (see FIG. 5), enabling the high voltage circuit 7 to be electrically connected to discharge a high voltage through the metal gas nozzle 55 and the metal flame tube 33. As a resutt sparks are produced in the space between the metal gas nozzle 55 and the metal flame tube 33 to ignite discharged fuel gas from the metal gas nozzle 55.

While only one embodiment of the present invention has been shown and described, it will be understood that various modifications and changes could be made thereunto without departing from the spirit and scope of the invention disclosed.

What the invention claimed is:

1. An electronic ignition gun comprising a casing defining a receiving chamber, a fuel gas container mounted in the receiving chamber inside said casing, said fuel gas container having a gas outlet valve, a metal gas nozzle mounted in said casing at a front end, a flexible gas tube connected between said gas outlet valve and said metal gas nozzle for guiding fuel gas from said fuel gas container to said metal gas nozzle, a metal flame tube mounted on the front end of said casing around said metal gas nozzle, said metal flame tube having a flame output hole at a front end thereof, a power supply device mounted in the receiving chamber inside said casing, a control switch, and a high voltage circuit connected to said power supply device through said control switch and controlled by said control switch to discharge a high voltage through said metal gas nozzle and said metal flame tube, wherein:

a pull tab is pivotally coupled to said gas outlet valve of said fuel gas container and driven to open said gas outlet valve, enabling fuel gas to flow out of said fuel gas container through said flexible gas tube to said gas nozzle for burning;

said control switch is a push-button switch mounted in a hole on said casing and depressed to drive said pull tab in opening said gas outlet valve, and to connect said high voltage circuit to said power supply device, enabling said high voltage circuit to discharge a high voltage, said push-button switch comprising a metal contact plate at a bottom side thereof; and said high voltage circuit has one end connected to said power supply device through an open circuit, which is closed by the metal contact plate of said push-button switch when said push-button switch is depressed, enabling electricity to be transmitted from said power supply device to said high voltage circuit, whereby said push-button switch controls both said flow of gas out of the fuel gas container and said high voltage discharge.

2. The electronic ignition gun of claim 1 wherein said casing comprises a peephole through which the volume of fuel gas in said fuel gas container is visually checked.

3. The electronic ignition gun of claim 1 wherein said gas nozzle has a front gas outlet mounted with a gas flow buffer spring, which the flowing speed of discharged fuel gas, enabling discharged fuel gas to be mixed with air.

4. The electronic ignition gun of claim 1 wherein said flame tube has a plurality of air vents around the periphery thereof near the flame output hole.

5. The electronic ignition gun of claim 1 further comprising a gas flow rate control extended out of a hole on said casing and operated to regulate the flow rate of fuel gas passing through said gas outlet valve of said fuel gas container.

6. The electronic ignition gun of claim 1 wherein the bottom side of said push-button switch is supported on a spring element, which has one end connected to the bottom side of aid push-button switch and an opposite end fastened to a recessed seat inside said casing.

7. The electronic ignition gun of claim 1 further comprising safety lock means controlled to stop said push-button switch from operation, said safety lock means comprising a sliding rail disposed inside said casing, a stop plate moved along said sliding rail between a first position where said push-button switch is stopped from downward movement by said stop plate, and a second position where said stop plate is moved away from said push-button switch, enabling said push-button switch to be depressed to connect said high voltage circuit to said power supply device.

8. The electronic ignition gun of claim 7 wherein said safety lock means further comprises a spring element having one end connected to said stop plate and an opposite end fastened to a recessed seat inside said casing, said stop plate being forced by the spring force of the spring element of said safety lock means into said first position.

9. The electronic ignition gun of claim 1 further comprising an electrically insulative bushing mounted within said flame tube around said gas nozzle.

* * * * *